US006355116B1

(12) United States Patent
Chen et al.

(10) Patent No.: US 6,355,116 B1
(45) Date of Patent: Mar. 12, 2002

(54) METHOD FOR RENEWING DIFFUSION COATINGS ON SUPERALLOY SUBSTRATES

(75) Inventors: Keng Nam Chen; Shih Tung Ngiam, both of Singapore (SG)

(73) Assignee: General Electric Company, Cincinnati, OH (US)

( * ) Notice: Subject to any disclaimer, the term of this patent is extended or adjusted under 35 U.S.C. 154(b) by 0 days.

(21) Appl. No.: 09/534,512

(22) Filed: Mar. 24, 2000

(51) Int. Cl.[7] ..... C23C 8/04

(52) U.S. Cl. ..... 148/280; 148/283; 134/41; 134/3; 156/344; 216/108; 216/109

(58) Field of Search ..... 134/41, 3; 156/344; 216/108, 109; 148/240, 280, 283

(56) References Cited

U.S. PATENT DOCUMENTS

| | | | | |
|---|---|---|---|---|
| 3,458,353 A | | 11/1966 | Baldi | 134/3 |
| 3,622,391 A | * | 11/1971 | Baldi | 134/3 |
| 4,142,023 A | | 2/1979 | Bornstein et al. | 428/680 |
| 4,302,246 A | | 11/1981 | Brindisi, Jr. et al. | 75/101 |
| 4,327,134 A | | 4/1982 | Baldi | 427/253 |
| 4,425,185 A | | 1/1984 | Fishter et al. | 156/656 |
| 4,525,250 A | | 5/1985 | Fahrmbacher-Lutz et al. | 204/58.5 |
| 4,554,049 A | * | 11/1985 | Bastenbeck | 156/656 |
| 4,746,369 A | | 5/1988 | Sullivan et al. | 134/3 |
| 5,071,678 A | | 12/1991 | Grybowski et al. | 427/253 |
| 5,225,246 A | | 7/1993 | Beers et al. | 427/252 |
| 5,248,381 A | | 9/1993 | Dunker et al. | 156/637 |
| 5,587,103 A | * | 12/1996 | Dennis | 252/79.3 |
| 5,624,721 A | | 4/1997 | Strangman | 427/585 |
| 5,630,879 A | | 5/1997 | Eichmann et al. | 118/720 |
| 5,645,893 A | | 7/1997 | Rickerby et al. | 427/405 |
| 5,837,385 A | | 11/1998 | Schaeffer et al. | 428/610 |
| 5,851,409 A | | 12/1998 | Schaeffer et al. | 216/2 |
| 5,856,027 A | | 1/1999 | Murphy | 428/623 |
| 5,866,271 A | | 2/1999 | Stuebber et al. | 428/545 |
| 5,882,415 A | | 4/1999 | Helling et al. | 118/723 |
| 5,900,102 A | | 5/1999 | Reeves | 156/344 |
| 5,944,909 A | | 8/1999 | Reeves et al. | 134/3 |
| 6,174,448 B1 | | 1/2001 | Das et al. | 216/2 |
| 6,238,743 B1 | | 5/2001 | Brooks | 427/307 |

OTHER PUBLICATIONS

U.S. application No. 09/730,373, Zimmerman et al., filed Dec. 5, 2000.

* cited by examiner

*Primary Examiner*—John Sheehan
*Assistant Examiner*—Andrew L. Oltmans
(74) *Attorney, Agent, or Firm*—Andrew C. Hess; David L. Narciso

(57) ABSTRACT

A method for controlled removal of a portion of a diffusion coating from the outer surface of a nickel-containing superalloy article. A diffusion coating typically includes a diffusion layer between an outer aluminide layer and the nickel-containing substrate. The method includes contacting the coated superalloy article in a preselected chemical stripping solution for a preselected period of time sufficient to remove only the outer aluminide layer, without substantially affecting the diffusion layer underlying the outer aluminide layer. After neutralizing the stripping solution, the article can be inspected and repaired as needed. The aluminide outer layer can then be restored in a conventional manner.

28 Claims, 1 Drawing Sheet

METHOD FOR RENEWING DIFFUSION COATINGS ON SUPERALLOY SUBSTRATES

FIELD OF THE INVENTION

This invention relates to diffusion coatings formed on superalloy substrates and specifically to a novel method of renewing the diffusion coatings formed on superalloy substrates.

BACKGROUND OF THE INVENTION

The current coatings used on superalloy substrates such as airfoils exposed to the hot gases of combustion in gas turbine engines for both environmental protection and as bond coats in thermal barrier coating (TBC) systems include aluminides of nickel and platinum. These coatings are applied over superalloy substrate materials, typically nickel-base superalloys, to provide protection against oxidation and corrosion attack. These coatings are formed on the substrate in a number of different ways. For example, a nickel aluminide, NiAl, typically is grown as an outer coat on a nickel base superalloy by exposing the substrate to an aluminum rich environment at elevated temperatures. The aluminum from the outer layer diffuses into the substrate and combines with the nickel diffusing outward from the substrate to form an outer coating of NiAl. Because the formation of the coating is the result of a diffusion process, it will be recognized that there are chemical gradients of Al and Ni, as well as other elements. However, Al will have a high relative concentration at the outer surface of the article which will thermodynamically drive its diffusion into the substrate creating a diffusion zone extending into the original substrate, and this Al concentration will gradually decrease with increasing distance into the substrate. Conversely, Ni will have a higher concentration within the substrate and will diffuse through the thin layer of aluminum to form a nickel aluminide. The concentration of Ni in the diffusion zone will vary as it diffuses outward to form the NiAl. At a level below the original surface, the initial Ni composition of the substrate is maintained, but the Ni concentration in the diffusion zone will be less and will vary as a function of distance into the diffusion zone. The result is that although NiAl forms at the outer surface of the article, a gradient of varying composition of Ni and Al forms between the outer surface and the original substrate composition. The concentration gradients of Ni and other elements that diffuse outwardly from the substrate and the deposited aluminum, Al, create a diffusion zone between the outer surface of the article and that portion of the substrate having its original composition. Of course, exposure of the coated substrate to an oxidizing atmosphere typically results in the formation of an alumina layer over the nickel aluminide.

In some coating systems, a platinum aluminide (PtAl) coating is formed by electroplating a thin layer of platinum over the nickel-base substrate to a predetermined thickness. Then, exposure of the platinum to an aluminum-rich environment at elevated temperatures causes the growth of an outer layer of PtAl as the aluminum diffuses into and reacts with the platinum. At the same time, Ni diffuses outward from the substrate changing the composition of the substrate, while aluminum moves inward through the platinum into this diffusion zone of the substrate. Thus, complex structures of (Pt,Ni) Al are formed by exposing a substrate electroplated with a thin layer of Pt to an atmosphere rich in aluminum at elevated temperatures. As the aluminum diffuses inward toward the substrate and Ni diffuses in the opposite direction through the Pt creating the diffusion zone, $PtAl_x$ phases precipitate out of solution so that the resulting Pt—NiAl intermetallic also contains precipitates of $PtAl_x$ intermetallic, where x is 2 or 3. As with the nickel aluminide coating, a gradient of aluminum occurs from the aluminum rich outer surface inward toward the substrate surface, and a gradient of Ni and other elements occurs as these elements diffuse outward from the substrate into the aluminum rich additive layer. Here, as in the prior example, an aluminum rich outer layer is formed at the outer surface, which may include both platinum aluminides and nickel aluminides, while a diffusion layer below the outer layer is created. As with the nickel aluminide coating, exposure of the coated substrate to an oxidizing atmosphere typically results in the formation of an outer layer of alumina.

These aluminides are also used as bond coats in thermal barrier systems, being intermediate between the substrate and an additional applied thermally resistant ceramic coating, such as yttria-stabilized zirconia (YSZ) which is applied over the aluminide. However, the process for forming these diffusion aluminides is essentially the same, that is to say, the substrate is exposed to aluminum, usually by a pack process or a CVD process at elevated temperatures, and the resulting aluminide formed as a result of diffusion.

Over time in the hot oxidizing environment of a gas turbine engine, the coatings, whether applied as an environmental coating or as a bond coat in a thermal barrier system eventually degrade as a result of one or a combination of ongoing processes which include erosion due to the impingement of hot gases on the airfoils, corrosion due to reaction of contaminants in the products of combustion with the metallic surfaces of the airfoil, and oxidation. Products of combustion frequently build up on these outer surfaces. In addition to degradation as a consequence of exposure to the hot engine environment, airfoils may be damaged in service due to a variety of factors, and require repair after removal of damaged regions by well-known processes such as welding, cladding or the PACH process. In order to repair an airfoil after service, it is necessary to remove not only the products of combustion, the corrosion products and oxidation products resulting from routine exposure to the engine environment, but also previously applied coatings, if they haven't already been removed as a result of service.

Prior art processes for repair of coated blades chemically strip any remaining coating from the turbine blades. One of these repair methods, as set forth in U.S. Pat. No. 4,746,369 involves acid stripping. Because the coatings are grown into the substrate by a diffusion process, acid stripping attacks the diffusion zone, which includes original substrate material, as well as the nickel aluminide and any outer layer of alumina. Of course, this acid stripping procedure is further complicated because the coatings are selected due to their ability to resist chemical attacks from corrosion processes and protect the substrate airfoil. Yet, existing methods of stripping the coatings are controlled chemical attacks upon the airfoil. Unless exceptional care is maintained, the chemical solutions used to remove the coating will vigorously attack the regions underlying the protective coating. So removal of the coating will affect the outer coating layer and the diffusion layer, and may involve a direct attack on the substrate or a portion of the substrate. Because the parts are thin, a repair process that removes at least a portion of the initial substrate that was incorporated into the diffusion zone limits the number of times that the airfoils can be reused since minimum allowable wall thicknesses cannot be violated.

Other methods such as disclosed in U.S. Pat. No. 4,425,185 have as their object removal of coatings such as nickel aluminides from Hastelloy-X substrates without adversely affecting the substrate. This method may minimize the impact on a Hastelloy-X substrate, which has a low Ni content in comparison to a Ni-base superalloy, but it still removes any diffusion zone formed between the nickel aluminide and the substrate. Furthermore, while this may be an effective method for an alloy such as Hastelloy X containing only about 50% Ni, it is not effective for a Ni-base superalloy which can include Ni in excess of 80%.

Another method for removing coatings is set forth in U.S. Pat. No. 5,851,409 to Schaeffer et al. and assigned to the assignee of the present invention. This method involves mechanically impacting the environmental coating at a temperature below the ductile-to-brittle transition temperature of the diffusion zone such as by shot peening. This mechanical action forms cracks in the coating that facilitates penetration of the stripping solution into the coating into the vicinity of the interface between the substrate and the diffusion zone and speeds the removal process. The difficulty with this method is that since there is significant, if not total penetration, of the diffusion zone, including removal of at least a portion of the diffusion zone that was incorporated from the initial substrate, the article is undesirably thinned as a result of the procedure.

What is needed is a method of removing the outermost layer of a nickel aluminide coating applied to a nickel-base superalloy substrate without affecting, or only minimally affecting, the diffusion layer substantially formed from the superalloy substrate, the diffusion layer being located below the outermost layer of nickel aluminide coating. Associated with the removal of the outermost layer of the coating is a method of restoring or renewing the nickel aluminide coating after repairs of the superalloy substrate has been repaired.

SUMMARY OF THE INVENTION

The present invention is applicable to nickel-based and nickel-containing superalloy components that operate at elevated temperatures and include aluminide coatings for environmental protection from a harsh environment or an elevated temperature atmosphere such as is found in the oxidative, corrosive exhaust of a jet engine. Typical nickel-base superalloy and cobalt-base superalloy components exposed to such environmental conditions include airfoils in the form of vanes, nozzles and blades, shrouds, combustion liners and augmentor hardware.

The present invention extends the life of this expensive engine hardware by removing the outer layer of the diffusion aluminide coating so that repair of the hardware can be accomplished with little or no removal of the underlying diffusion layer of the diffusion aluminide coating. The protective diffusion aluminide coatings are formed on superalloy components by exposing the component substrates to an aluminum species by using any one of a number of well-known processes. A platinum layer may be electrodeposited onto the superalloy substrate prior to exposure of the component substrate to the aluminum species. The resulting protective coating is formed as a result of diffusion of aluminum into the underlying material, which is either a nickel-base superalloy substrate, a cobalt-base superalloy substrate or a platinum-plated superalloy substrate. The coating has at least two distinct portions overlying the unmodified superalloy substrate. The first portion is an outer portion comprised of a layer that is substantially an aluminide. This aluminide layer is formed as the major elemental components of the substrate, Ni and/or Co, diffuse outward from the substrate and combine with the aluminum in the additive layer. If platinum is present, the aluminide may form PtAl, NiAl, CoAl and combinations thereof, depending upon the chemical composition of the substrate. Because these aluminides are ordered intermetallics formed by diffusion, initially there will be a gradient of Al and Pt, NiAl and/or NiAl and/or CoAl across the outer portion. The second portion is a diffusion layer that has a chemical composition resulting from the high temperature diffusion of elements from the additive aluminum and the substrate, yet different from them. This diffusion layer is intermediate between the unaffected substrate and the outer additive layer and incorporates a portion of the initial substrate. The composition of this layer will vary due to the various elements comprising it. If the substrate includes an electroplated Pt layer, there will be an optional Pt-rich layer between the substrate and the outer additive layer. Upon exposure to an oxidizing atmosphere, any excess Al in the outer additive portion typically will combine with oxygen to form an alumina layer.

In accordance with the present invention, any products of combustion that may have been deposited on the outer layer of the superalloy component are first cleaned off by conventional methods. These methods include light mechanical buffing or cleaning utilizing suitable chemical solvents. The superalloy article then is contacted with a preselected chemical stripping solution for a preselected time. The article is permitted to remain in the solution only for a period of time sufficient to remove at least a portion of the additive outer layer from the substrate. The superalloy substrate is then withdrawn from contact with the chemical stripping solution with at least a portion of the additive outer layer having been removed. The stripping solution on the superalloy substrate is neutralized so that erosion of the remaining coating will not continue.

At the conclusion of the stripping operation, the nickel-based superalloy substrate may be repaired in accordance with established procedures if needed, and then recoated. Repairs can include welding, cladding, PACH, brazing and other established procedures. The article can then be coated in accordance with established methods for applying coatings.

An advantage of the present invention is that only the outer additive layer of the aluminide coating is affected by removal from the article under repair. The diffusion layer underlying the outer additive layer is substantially unaffected.

Another advantage of the present invention is the protective outer layer can be restored by a conventional VPA process that adds a layer of aluminum, allowing the aluminide layer to be restored within the additive layer by diffusion of Ni, Co and combinations thereof from the remaining underlying material so that there is no weakening or thinning of the part due to the stripping process. Alternatively, a thin layer of Pt can be electroplated and complex (Ni, Pt)Al and/or (Co, Pt) Al may be formed.

Still another advantage of the present invention is that it extends the life of the nickel based superalloy article by enabling it to undergo an increased number of repair cycles. The article can be stripped, repaired and recoated without any loss of component thickness, and the repaired article has a restored protective coating that is as effective as the original coating.

Other features and advantages of the present invention will be apparent from the following more detailed description of the preferred embodiment, taken in conjunction with the accompanying drawings which illustrate, by way of example, the principles of the invention.

DETAILED DESCRIPTION OF THE PREFERRED EMBODIMENT

Figure 1:
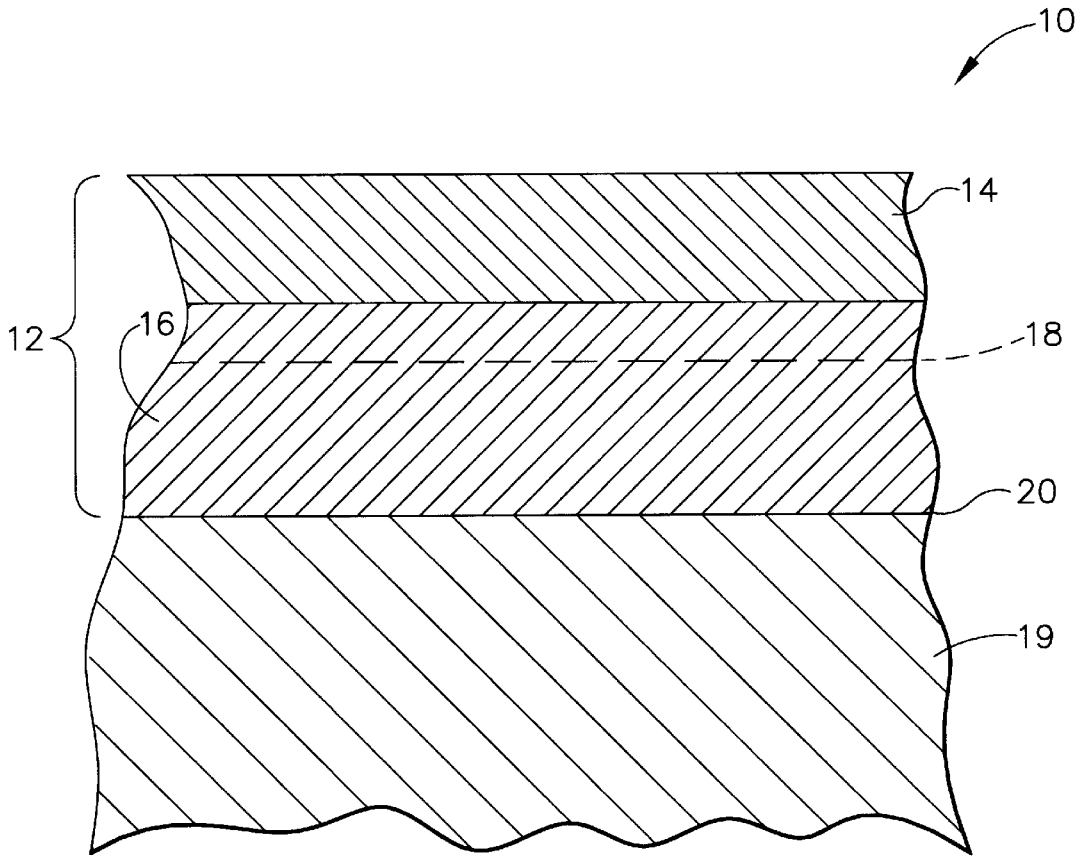
FIG. 1 is a partial cross section of a coated nickel-based superalloy article depicting the additive layer, the diffusion layer and the substrate.

The present invention is generally applicable to nickel-based superalloy components having diffusion aluminide coatings formed thereon either to provide environmental protection or to serve as a bond coat layer for subsequently applied thermal barrier coatings. These components operate in hostile environmental conditions, usually in a hot oxidative and corrosive atmosphere at elevated temperatures. Notable examples of such components can be found in the hot sections of gas turbine engines and include turbine blades and vanes. Other illustrative examples include shrouds, combustor liners and augmentor hardware.

Referring now to FIG. 1 which is a partial cross-section taken perpendicular to a plane through the centerline extending to the outer surface of a turbine blade 10 coated with a diffusion aluminide coating 12. The base material of the turbine blade may be a superalloy of Ni or Co, or combinations of Ni and Co. Both the Ni in a nickel base superalloy and Co in a cobalt base superalloy diffuse outward from the substrate to form diffusion aluminides, and the superalloys may include both Ni and Co in varying percentages. While discussion of the superalloy substrate may be in terms of Ni-base superalloys, it will be understood that a Co-base superalloy substrate or a NiCo-base superalloy substrate can be substituted, as the process for forming diffusion aluminides in these substrates is substantially the same. The blade 10 is coated with an additive aluminum layer by exposing the blade to a gaseous species of aluminum at elevated temperatures. This is accomplished by any one of a number of well-known industrial processes. Exemplary examples include vapor gas phase alumininiding such as CVD and over-the-pack processing. Prior to exposure to the aluminum, the blade is optionally electroplated with a platinum (not shown in FIG. 1), if a modified (Pt,Ni) aluminide coating is desired. A nickel aluminide coating, or a modified (Pt,Ni) aluminide when Pt is included, is formed at the outer layer, also referred to as the outer additive layer and designated as 14 in FIG. 1, as Ni from the substrate matrix diffuses outward toward the Al-rich additive layer as the blade is held at an elevated temperature. Of course, diffusion is not restricted to Ni, and other elements diffuse outward from the substrate 19 as aluminum diffuses inward from the outer additive layer as the system attempts to achieve thermodynamic equilibrium. This creates a diffusion zone or layer 16 as shown in FIG. 1. Composition gradients of various elements also will exist in the diffusion zone. In the outer additive zone, however, there is formed Mal and Al, where M is an element selected from the group consisting of Pt, Ni, Co and combinations thereof. For nickel-based superalloys, the outer additive zone is primarily nickel aluminide or optionally (Pt,Ni)Al when Pt is present. An excess of aluminum may also exist which can naturally form a very thin outer scale of alumina (not shown) upon exposure of the blade to an oxidizing atmosphere. The alumina scale, if formed, is measured in angstroms or fractions of microns. The overall thickness of the diffusion aluminide coating 12 may vary, but typically is no greater than about 0.004 inches and more typically being about 0.003 inches in thickness. The diffusion layer 16 which is grown into the substrate, typically is about 0.0005–0.0015 inches thick, more typically, about 0.001 mil thick, while the outer additive layer 14 comprises the balance, usually about 0015–0.002 inches. Referring again to FIG. 1, the incorporation of the substrate into the diffusion layer is depicted as the distance between 18, which represents the initial composition of the substrate at time $t_1$, and interface 20, which represents that portion of the substrate still having substantially its initial composition at a later time $t_2$ when further growth is insignificant.

Application of the methods of the present invention affects substantially only the outer additive layer 14. Unlike prior art methods that remove the entire diffusion aluminide coating 12, that is at least 0.003–0.004 inches, and in some cases, a portion of the substrate below the diffusion aluminide (i.e. below interface 20), the present invention only removes the outer additive layer 14. It is within the scope of the present invention to remove the entire additive layer 14 and a small portion of diffusion layer 16, but only to a depth of a few tenths of a mil. In the preferred embodiment, only the outer additive layer is removed.

The coated superalloy substrate, such as a turbine airfoil, which is typically a nickel-based superalloy or a cobalt-based superalloy, is removed from service. Products of combustion, which have accumulated on the surface are, removed either by application of a suitable solvent or by mechanical working. Certain component designs may include ceramic thermal barrier coatings that require removal to expose the aluminide coating when it is used as a bond coat. The article is inspected for defects that may have formed in the article over its time in operation, which can include cracks, gouges and erosion. The article is then immersed in a chemical stripping solution such as $HNO_3$+ $NH_4F$ or ASC 2-N for a time sufficient to remove outer additive layer 14. Of course, the amount of time required to remove the outer layer will depend on a number of variables, including but not limited to, the thickness of that layer, the concentration of the solutions, the temperature of the solutions, the presence of activators and the chemical composition of the substrate. To remove 0.0015–0.002 inches of outer additive layer from a Rene 80 turbine airfoil, the component should be immersed in the stripping solution at ambient temperature for no greater than about 60 minutes, and desirably about 25–35 minutes. As used herein, ambient temperature is used interchangeably with room temperature and represents the range of temperatures in a production or repair facility from summer to winter between about 60–90° F. (15–32° C. ). Turbine airfoils made from different substrates may require more or less time to remove the additive layer. The airfoils may also be immersed in a stripping solution and heated to a preselected temperature above ambient. However, the time in the solution will be adjusted downward to account for the increased chemical activity at elevated temperatures. After such removal, the chemical stripping solution is neutralized, either by exposure to water or a mild basic solution such as a an aqueous solution of NaOH, KOH, $Na_2CO_3$, preferably having a pH of between about 7 and about 9, to inhibit further removal of material.

In one embodiment of the present invention, the chemical stripping solution includes $NH_4F$. $NH_4F$ is dissolved in a solution of nitric acid and water. The solution includes about 10% to about 75% concentrated nitric acid and water. About 0.1–1.0 grams of $NH_4F$. is dissolved in each liter of the nitric acid/ water solution.

In another embodiment of the present invention, the chemical stripping solution includes $NH_4Cl$. $NH_4Cl$ is dissolved in a solution of nitric acid and water. The solution includes about 10% to about 75% concentrated nitric acid and water. About 0.1–1.0 grams of $NH_4Cl$ is dissolved in each liter of the nitric acid/ water solution.

Another chemical stripping solution used to practice the present invention includes ammonium hydrogen difluoride. Ammonium hydrogen difluoride is dissolved in a solution of nitric acid and water. The solution includes about 5% to about 15% concentrated nitric acid and water. About 10–20 grams of ammonium hydrogen difluoride is dissolved in each liter of the nitric acid/ water solution.

The temperatures of the solutions are maintained at ambient, but may be raised to about 80° C. (176° F. ). However, as will be recognized by one skilled in the art, raising the temperature of the solutions will increase the chemical activity, so that the amount of time required for immersion should be correspondingly reduced.

EXAMPLE 1

Turbine blades made of the nickel-base superalloy Rene 80 were immersed in a solution consisting of approximately 0.3 g of $NH_4F$ per liter of dilute nitric acid, where the dilute nitric acid has a concentration in water of approximately 25% by volume concentrated nitric acid, for about 30 minutes at ambient temperature. The blades were then withdrawn from the stripping solution and immersed in water to neutralize the stripping effects of the solution. The blades optionally may be neutralized using a mild basic solution such as dilute KOH or NaOH in water. The neutralizing agent optionally may be applied by spraying or wiping as desired. The stripping operation removed most of the 0.0019 inches of outer additive layer 14 (mean thickness), leaving about 0.0001 inches of outer additive layer 14 overlying the unaffected diffusion layer. The blades were inspected for proper removal of the coating and for other imperfections or defects prior to repair.

EXAMPLE 2

Rene 80 blades were immersed in a solution of ASC 2-N for between about 25–35 minutes, but typically and preferably about 30 minutes. ASC 2-N solution is made up by mixing in a dilute nitric acid solution a material sold under the trade name "ASC 2-N Stripper" by Alloy Surfaces Company, Incorporated of Wilmington, Del. ASC 2-N solution consists predominantly of ammonium hydrogen difluoride, nitric acid and water. The ASC 2-N Solution is comprised of approximately 15 grams of "ASC 2-N Stripper" per liter of solution, in a mixture of 8% concentrated nitric acid (by volume) in water. The blades were then withdrawn from the stripping solution and immersed in water or optionally a dilute basic solution having a pH of between 7 and 9 to neutralize the stripping effects of the solution. About 0.001 inches of outer additive layer 14 (mean) was removed, leaving about 0.0005 inches of outer additive layer (mean) overlying the unaffected diffusion zone 16.

EXAMPLE 3

Rene 125 blades were immersed in a solution comprised of approximately 0.3 g of $NH_4F$ per liter of dilute nitric acid, where the dilute nitric acid has a concentration of approximately 25% by volume of concentrated nitric acid in water, held at ambient temperature for about 5–10 minutes, and preferably about 7.5 minutes. The blades were then withdrawn from the stripping solution and immersed in water to neutralize the stripping effects of the solution. The stripping operation removed most of the 0.002 inches of outer additive layer 14 (mean thickness), leaving about 0.0001 inches of outer additive layer 14 overlying the unaffected diffusion layer.

EXAMPLE 4

Rene 125 blades were immersed in ASC 2-N solution, such as set forth in Example 2, held at ambient temperature for about 25–35 minutes, and preferably about 30 minutes. The blades were then withdrawn from the stripping solution and immersed in water to neutralize the stripping effects of the solution. The stripping operation removed about 0.001 inches of the outer additive layer 14 (mean thickness), leaving about 0.0005 inches of outer additive layer 14 overlying the unaffected diffusion layer. The blades were subsequently inspected for satisfactory removal of the coating and for the presence of other defects.

While examples 1 and 3 utilized $HNO_3$+$NH_4F$ for stripping, a solution of $HNO_3$+$NH_4Cl$ may be substituted to remove the outer additive layer.

In each example, the blades were inspected for defects and repaired as required. Repair may be accomplished by a series of suitable commercial repair techniques including laser cladding, superalloy welding at elevated temperature (SWET), electrode discharge machining and mechanical working. The diffusion aluminide coating 12 was restored to the blades by recoating them with aluminum using an aluminizing process, such as vapor gas phase aluminizing, CVD and over-the-pack processing. These methods are used in the restoration processes for repaired components in which all of the coating is removed, as well as to form coatings in new components. However, any method of applying aluminum to the parts may be used. The coating temperature and times used to form coatings in partially stripped components were identical to that conventionally used for coating, stripped turbine components in which all of the diffusion aluminide coating 12 was removed. The final diffusion coating thickness 12 of the Rene 80 blades stripped in accordance with the present invention using ASC 2-N solution and restored by aluminizing was about 0.002 inches (mean), which compares favorably with the prestrip thickness of about 0.0025 inches (mean). The final diffusion coating thickness 12 of Rene 80 blades stripped in accordance with the present invention using $HNO_3$+$NH_4F$ solution and restored by aluminizing was about 0.0027 inches (mean) as compared to prestrip coating thickness 12 of about 0.0029 inches. Metallographic examination of the blades after coating showed that the coating thickness and structure is predominantly the same as before stripping. Thus, not only is the coating substantially restored to the original state, but this restoration is accomplished without any detrimental effect on the component wall thickness.

In these examples, it is convenient to restore the coating to the partially stripped blade using an identical process and processing conditions to that used to apply coating to completely stripped blades. This has the advantage of allowing a common process to be used to coat partially stripped and completely stripped blades. However, those skilled in the art will recognize that it is possible to recoat the partially stripped blades using different processing conditions or different coating processes from that used to recoat completely stripped blades. The choice of processing conditions and coating process is a matter of convenience for the repairer so long as the restored coating is able to provide acceptable oxidation and corrosion resistance to the repaired component.

Although the present invention has been described in connection with specific examples and embodiments, those skilled in the art will recognize that the present invention is capable of other variations and modifications within its scope. These examples and embodiments are intended as typical of, rather than in any way limiting on, the scope of the present invention as presented in the appended claims.

What is claimed is:

1. A method for controlled removal of at least a portion of a thickness of an additive coating from a coated superalloy substrate, the method comprising the steps of:

providing a coated superalloy substrate comprising an outer additive layer and a diffusion zone between the outer additive layer and the superalloy substrate;

contacting the coated superalloy substrate with a chemical stripping solution for a preselected time under preselected conditions sufficient to at least partially remove the outer additive layer from the substrate without substantially affecting the diffusion zone, the chemical stripping solution consisting essentially of about 0.1 to about 0.3 grams of $NH_4F$ per liter of about 10% to 75% by volume concentrated nitric acid in water, or about 0.1 to 1.0 grams of $NH_4Cl$ per liter of about 10% to 75% by volume concentrated nitric acid in water, or about 10 to 20 grams of ammonium hydrogen difluoride per liter of about 5% to 15% by volume concentrated nitric acid in water;

withdrawing the superalloy substrate having the at least partially removed outer additive layer from contact with the chemical stripping solution; and neutralizing the stripping solution to inhibit further coating removal.

2. The method of claim 1 wherein the step of providing includes providing a superalloy substrate comprised of a superalloy selected from the group consisting of Ni-based superalloys and Ni—Co-based superalloys.

3. The method of claim 2 wherein the superalloy substrate includes a coating of a diffusion aluminide applied by reacting the surface of the substrate with an aluminum species to form the additive outer layer of MAl and Al, where M is Pt, Co, Ni and combinations thereof, and the diffusion zone is formed below the additive layer during high temperature exposure by elemental diffusion with the substrate.

4. The method of claim 3 wherein the chemical stripping solution consists of about 0.1 to 0.3 grams of $NH_4F$ per liter of about 10% to 75% by volume concentrated nitric acid in water.

5. The method of claim 4 wherein the chemical stripping solution is maintained at a temperature between about 15° C. and about 80° C.

6. The method of claim 5 where the chemical stripping solution is maintained at ambient temperature.

7. The method of claim 3 wherein the chemical stripping solution consists of about 0.1 to 1.0 grams of $NH_4Cl$ per liter of about 10% to 75% by volume concentrated nitric acid in water.

8. The method of claim 7 where the chemical stripping solution is maintained at a temperature between about 15° C. to about 80° C.

9. The method of claim 8 where the chemical stripping solution is maintained at ambient temperature.

10. The method of claim 7 wherein the preselected time for immersing the coated superalloy substrate is no greater than about 60 minutes.

11. The method of claim 10 wherein the preselected time for immersing the coated superalloy substrate is about 30 minutes.

12. The method of claim 4 wherein the chemical stripping solution consists of about 0.3 grams of $NH_4F$ per liter of about 25% by volume concentrated nitric acid in water.

13. The method of claim 12 wherein the coated superalloy substrate is Rene 80 immersed for a preselected time between about 25–35 minutes.

14. The method of claim 13 wherein the preselected time is about 30 minutes.

15. The method of claim 12 wherein the superalloy substrate is Rene 125 immersed for a preselected time between about 5–10 minutes.

16. The method of claim 3 wherein the chemical stripping solution consists of about 10 to 20 grams of ammonium hydrogen difluoride per liter of about 5% to 15% by volume concentrated nitric acid in water.

17. The method of claim 16 where the chemical stripping solution is maintained between about 15° C. and about 80° C.

18. The method of claim 17 where the chemical stripping solution is maintained at ambient temperature.

19. The method of claim 16 wherein the coated superalloy substrate is immersed for a preselected period of time no greater than about 60 minutes.

20. The method of claim 19 wherein the superalloy substrate is Rene 80 and the preselected time is about 25–35 minutes.

21. The method of claim 20 wherein the preselected time is about 30 minutes.

22. The method of claim 19 wherein the superalloy substrate is Rene 125 and the preselected time is about 25–35 minutes.

23. The method of claim 22 wherein the preselected time is about 30 minutes.

24. The method of claim 1 wherein the step of neutralizing the stripping solution further includes contacting the withdrawn substrate with a basic solution.

25. The method of claim 24 wherein the basic solution is a solution of NaOH, KOH or $Na_2CO_3$ in water having a pH of between about 7 and 9.

26. The method of claim 1 wherein the step of neutralizing the stripping solution further includes contacting the substrate with water.

27. A method for repairing a coated superalloy substrate, comprising the steps of:

providing a coated superalloy substrate comprising an outer additive layer and a diffusion zone between the outer additive layer and the superalloy substrate;

immersing the coated superalloy substrate in a chemical stripping solution for a preselected time sufficient to at least partially remove the outer additive layer from the substrate without affecting the diffusion zone, the chemical stripping solution consisting essentially of about 0.1 to about 0.3 grams of $NH_4F$ per liter of about 10% to 75% by volume concentrated nitric acid in water, or about 0.1 to 1.0 grams of $NH_4Cl$ per liter of about 10% to 75% by volume concentrated nitric acid in water, or about 10 to 20 grams of ammonium hydrogen difluoride per liter of about 5% to 15% by volume concentrated nitric acid in water;

withdrawing the superalloy substrate having the at least partially removed outer additive layer from the chemical stripping solution;

neutralizing the stripping solution to inactivate further coating removal;

inspecting the superalloy substrate;

repairing imperfections in the superalloy substrate;

restoring the outer additive layer of the superalloy substrate by exposing the superalloy substrate to a gaseous phase of aluminum at an elevated temperature for a time sufficient to deposit a preselected amount of aluminum over the outer surface of the partially stripped substrate; and forming a protective aluminide coating by heat treating the superalloy substrate at a preselected elevated temperature.

28. The method of claim 27 wherein the processes of restoring the outer additive layer of the superalloy substrate by exposing the superalloy substrate to a gaseous phase of aluminum at a preselected elevated temperature substantially identical to the restoration processes for outer additive layers on nickel containing superalloy substrates in which the previous coatings are completely removed.

* * * * *